US005816719A

United States Patent [19]

Palmer

[11] Patent Number: 5,816,719

[45] Date of Patent: Oct. 6, 1998

[54] PRINTER FOR PRINTING ON A CONTINUOUS PRINT MEDIUM

[75] Inventor: Anthony James Palmer, Betchworth, United Kingdom

[73] Assignee: ITW Limited, United Kingdom

[21] Appl. No.: 881,280

[22] Filed: Jun. 24, 1997

[51] Int. Cl.[6] ..... B41J 2/315; B41J 33/14

[52] U.S. Cl. ..... 400/120.01; 400/232

[58] Field of Search ..... 400/120.01, 232; 347/188

[56] References Cited

U.S. PATENT DOCUMENTS

| | | | |
|---|---|---|---|
| 4,167,342 | 9/1979 | Mower et al. | 400/124 |
| 4,683,479 | 7/1987 | Horiya et al. | 348/76 PH |
| 4,933,867 | 6/1990 | Ishigaki | 364/519 |
| 5,112,149 | 5/1992 | Suenaga | 400/88 |
| 5,149,212 | 9/1992 | Murakami | 400/121 |
| 5,372,439 | 12/1994 | Poole et al. | 400/232 |
| 5,448,283 | 9/1995 | Takeuchi | 347/217 |

FOREIGN PATENT DOCUMENTS

| | | |
|---|---|---|
| 0 036 295 | 9/1981 | European Pat. Off. . |
| 0 138 444 | 4/1985 | European Pat. Off. . |
| 0 285 024 | 10/1988 | European Pat. Off. . |
| 0 635 368 | 1/1995 | European Pat. Off. . |

*Primary Examiner*—Edgar S. Burr
*Assistant Examiner*—Dave Ghatt
*Attorney, Agent, or Firm*—Schwartz & Weinrieb

[57] ABSTRACT

A thermal printer for printing on a continuous print medium by ink transfer from a thermal print ribbon has a print head which is pivotally mounted and which is driven in an oscillatory pivotable motion by a stepper motor so as to repeatedly bring a linear array of energizable printing elements to bear against a platen roller. The print medium is fed through the printer between the platen roller and the print head. The instantaneous rate of travel of the print medium past the print head is substantially the same as the rate of feed of the print medium to the printer. The ribbon also travels between the print head and the platen roller, overlying the print medium, and is driven in such a manner that it travels at the same rate as the print medium during each printing operation up to a speed equivalent to the maximum printing speed of the print head. This is achieved by driving the ribbon with a motor the speed of which is controlled according to the sensed speed of travel of the print medium, such as, for example, by coupling the motor to processing circuitry which takes an input signal from a shaft encoder associated with the platen roller. To restore the aspect ratio of characters when the print medium is travelling faster than the speed equivalent to the maximum speed of the print head, lines of dots are skipped.

24 Claims, 4 Drawing Sheets

PRINTER FOR PRINTING ON A CONTINUOUS PRINT MEDIUM

FIELD OF THE INVENTION

The present invention relates generally to thermal printers, and more particularly to thermal printers for printing on a continuous print medium by thermal ink transfer from a print ribbon.

BACKGROUND OF THE INVENTION

It is known to print continuous packaging material and other continuous print media such as label bearing substrates with alphanumeric information and other symbols using a thermal transfer printer. A print head having a row of electronically driven heating elements is brought to bear against an ink-carrying thermal transfer ribbon disposed over the print medium while the print medium is driven perpendicularly to the row of print elements. In one known printer, the ribbon is supplied from a take-off spool and then passes along a ribbon path which extends between the print head and the path of the print medium, and thereafter is fed onto a take-up spool, the ribbon travelling across the print head at, at least, approximately the same speed as the print medium while printing is taking place. The path followed by the print medium extends around movable rollers which deflect the print medium by variable amounts both upstream and downstream of the print head. These rollers impose significant stresses on the print medium and complicate threading when the print medium is loaded into the printer. Such a printer typically operates at print medium speeds of up to 200 mm per second.

OBJECT OF THE INVENTION

It is an object of the present invention to provide an improved printer for continuous printing on a continuous print medium.

SUMMARY OF THE INVENTION

According to a first aspect of the present invention, there is provided a thermal printer, for printing on a continuous print medium by ink transfer from a thermal print ribbon, which comprises means defining a print medium path, a thermal print head having energizable print elements and located adjacent to the print medium path, means defining a print ribbon path which is interposed between the print head and the print medium path, and which also extends in the same direction as the print medium path, print ribbon drive means operable to drive a print ribbon at varying speeds along the print ribbon path, speed sensing means operable to sense the speed of travel of the print medium along the print medium path, and processing means, including memory means, arranged during printing to control the ribbon drive means in order to vary the ribbon speed up to a maximum speed which substantially corresponds to the maximum printing speed of the print head, and to activate selected print elements, according to predetermined patterns of dots stored in the memory means, so as to cause the transfer of ink from the print ribbon to the print medium and thereby form the predetermined pattern of ink dots on the print medium as it moves past the print head along the print medium path, and being additionally arranged to monitor the speed of the print medium using the speed sensing means such that when the print medium speed is greater than the print ribbon speed, the processing means activates the print elements such that selected ink dots are omitted from the predetermined pattern.

In the prior art machine, where the print medium passes the print head at a speed greater than the maximum printing speed of the print head, print ribbon is wasted. This is because the print medium and the print ribbon travel past the print head at the same speed. By limiting the print ribbon speed to a speed which corresponds to the maximum printing speed of the print head, that is, a print ribbon speed at which the used portions of the print ribbon are adjacent to one another when the print head is operating at maximum speed, print ribbon is saved. It will be appreciated that in the prior art machine, the used portions of the print ribbon are spaced apart. Correspondingly, the printed pattern on the print medium is spaced apart thus stretching the intended aspect ratio of the printed pattern in the travel direction of the print medium. The present invention solves this additional problem by omitting selected ink dots from the predetermined printed pattern. This has the effect of condensing the printed pattern in the travel direction of the print medium thereby tending to restore the aspect ratio of the printed pattern.

Typically, the print elements are arranged in a line in the print head transversely of the travel direction of the print medium. Preferably, the processing means is arranged to cause dots to be omitted by periodically skipping a set of dots, that is, a single one of the lines of dots, and instead, to activate the elements according to the subsequent set of dots stored in the memory means. Thus it will be appreciated that a line of dots is truly omitted and replaced with the subsequent line of dots rather than merely being delayed to the next printing operation of the print head which would not have the desired condensing effect.

Preferably, the processing means is arranged to skip X sets on average wherein X=1—(MAX/speed of print medium) and wherein MAX is the print medium speed substantially corresponding to the maximum printing speed of the print head. By arranging for sets of dots to be skipped according to this formula, the aspect ratio of the printed pattern is accurately restored. For example, when the ratio, of the speed of the print medium with respect to the print medium speed which substantially corresponds to the maximum printing speed of the print head, is 1.25, by omitting on average 0.2 of the lines of dots, that is, one line in five, the effective width of the pattern printed upon the print medium is restored to the width that it would have if the print medium was running at a speed only equivalent to MAX. Since MAX is the print medium speed that equates to the maximum printing speed of the print head, that is, the print medium speed at which the print head is able to print sufficiently quickly so as to maintain the correct aspect ratio of the printed pattern, the aspect ratio of the printed pattern is restored albeit with some loss of detail due to the omitted set or sets of dots.

Preferably, the speed with which the print ribbon is driven during each printing operation is variable in response to the speed of travel of the print medium so as to match the speed with which the print medium is fed past the print head up to the aforenoted maximum speed. This may be achieved, for example, by forming the platen as a roller around which the print medium is wrapped so that the speed of rotation of the roller is a measure of the speed of passage of the print medium. A shaft encoder, typically an optical encoder, may be used to provide an input to processing means forming part of the printing actuator so as to control the movement of the print head and energization of the printing elements. In addition, the print ribbon may be driven by a stepper motor coupled to a ribbon drive roller, the speed of operation of the stepper motor being governed by the sensed speed of rotation of the platen roller.

In the preferred embodiment, the speed of the print ribbon is limited by reducing, for every two sets of dots which are skipped, the amount of print ribbon which is fed past the print head by an amount which is equal to the length of print ribbon used by a single set of dots. For example, assuming that each set of dots uses 0.25 mm of ribbon length, then in accordance with the preferred embodiment, if two sets of dots are omitted, then without this feature, 0.5 mm of ribbon length would be fed past the print head and wasted since it would not be used. In accordance with the preferred embodiment, however, only 0.25 mm of print ribbon is fed past the print head, that is, 0.25 mm less than would normally have been fed past the print head.

According to a method aspect of the present invention, the present invention comprises a method, for saving print ribbon in a thermal printer for printing on a continuous print medium by ink transfer from a thermal print ribbon to the continuous print medium, wherein the printer includes a thermal print head having energizable print elements, which comprises the steps of passing a print medium past the print head at a speed greater than the equivalent maximum printing speed of the print head, passing the print ribbon past the print head in the same direction as the print medium at a speed equivalent to the maximum printing speed of the print head, selectively energizing the print elements so as to transfer ink from the print ribbon to the print medium in accordance with a predetermined pattern of ink dots, and periodically omitting ink dots from the predetermined pattern of ink dots by skipping a set of ink dots of the pattern of ink dots and replacing the skipped set of ink dots with a subsequent set of ink dots.

Preferably, the method includes removing one unit of ribbon length, which is typically 0.25 mm, for each two sets of ink dots omitted as described above in connection with the apparatus aspect of the present invention. This technique saves print ribbon since less print ribbon is used as sets of ink dots are removed. The same ribbon length will therefore last longer than in the prior art machines.

The present invention is applicable primarily to printing variable information on continuous plastic film packaging material, with each print operation being triggered by, for example, sensing the position of products to which the packaging material is to be applied as they travel along an adjacent conveyor. Typically, the information includes sell-by dates, serial numbers, pricing information, and bar codes.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
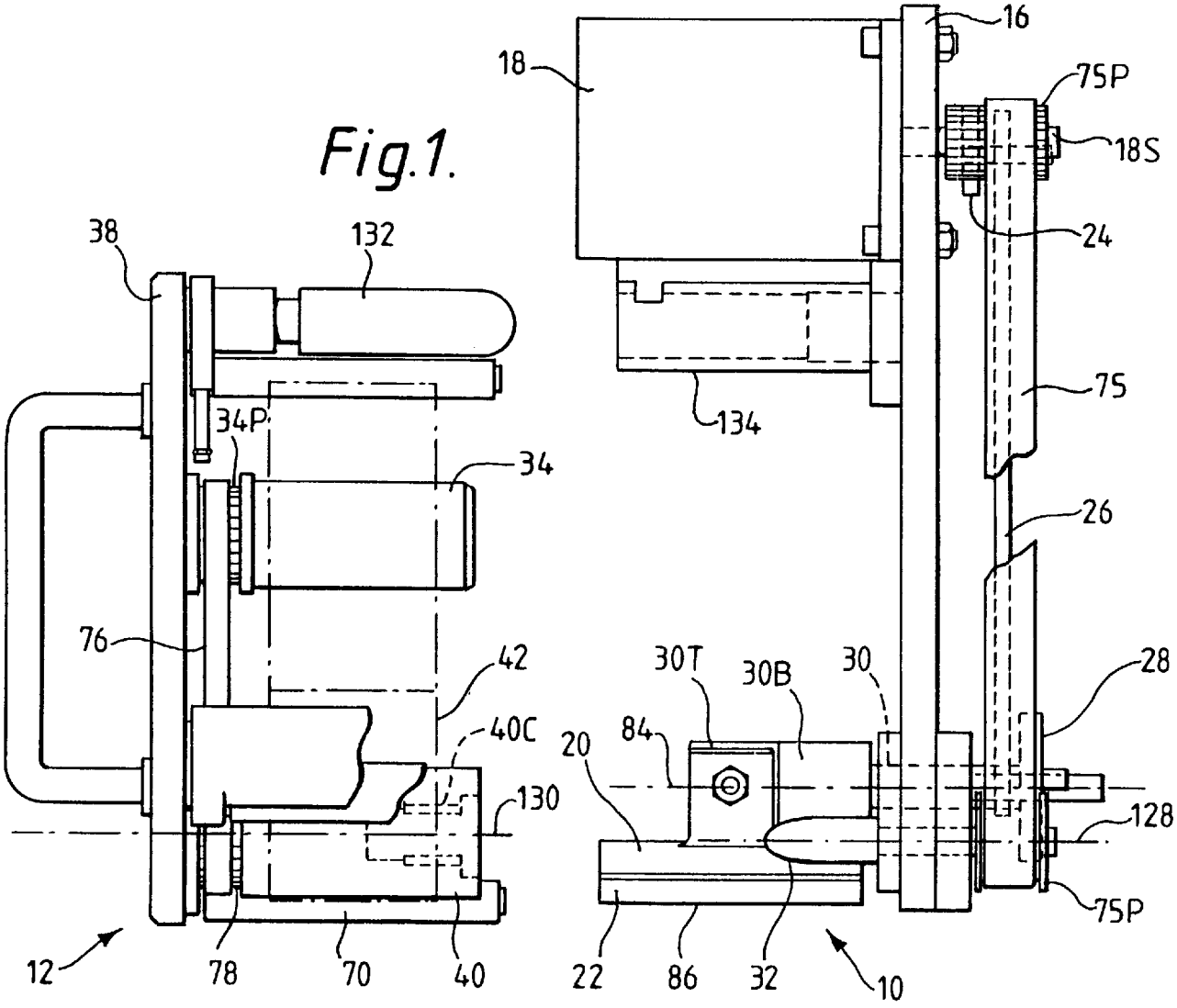
FIG. 1 is a diagrammatic exploded side view of a printer constructed in accordance with the present invention.
Figure 2:
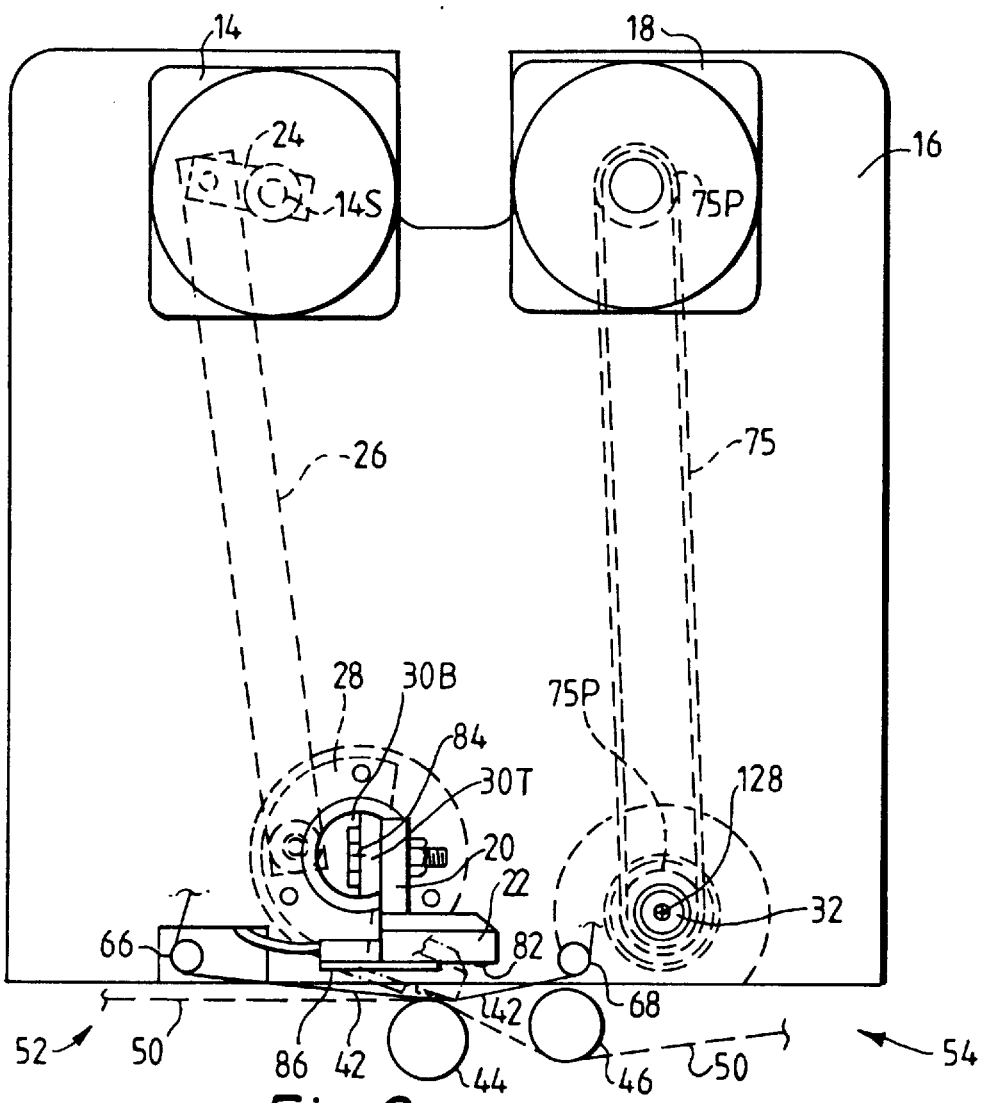
FIG. 2 is a front elevation view of a base unit of the printer of FIG. 1.
Figure 3:
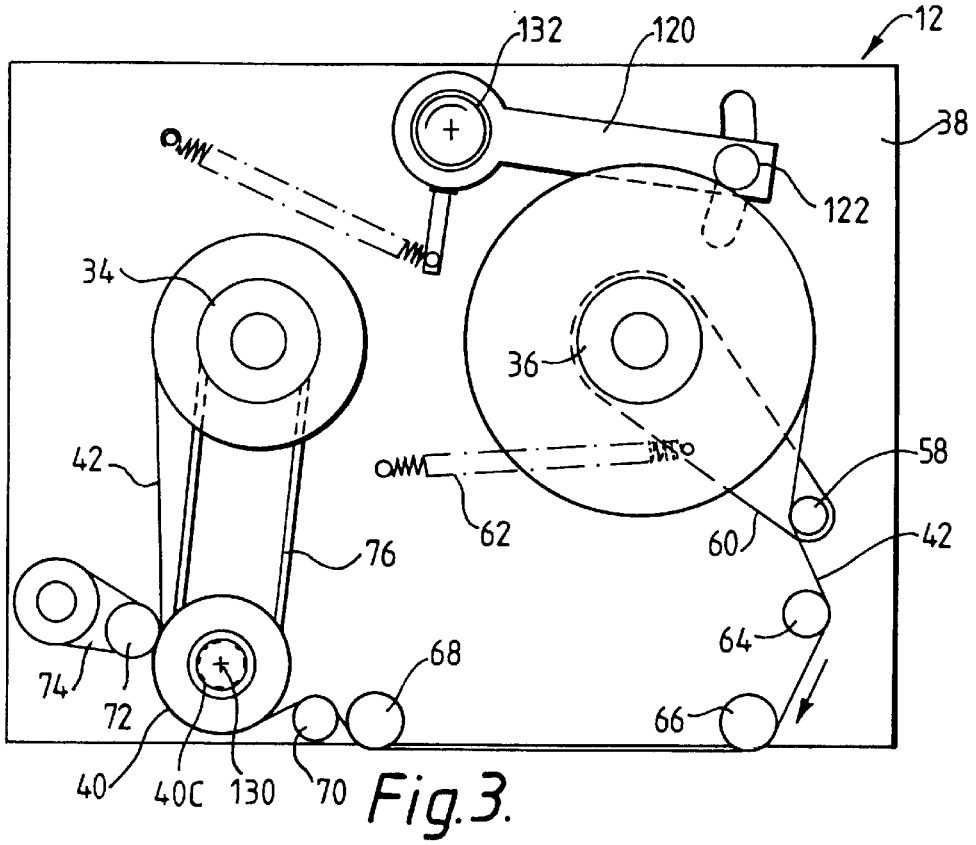
FIG. 3 is a rear elevation view of a ribbon cassette of the printer of FIG. 1.

Referring now to the drawings, and more particularly to FIGS. 1–3 thereof, a printer for the continuous printing of a continuous print medium by transfer of ink from a thermal transfer print ribbon to the continuous print medium comprises a base unit 10 and a removable ribbon cassette unit 12. The base unit 10, which is mounted upon a frame of the printer, not shown, comprises a print head stepper motor 14 mounted upon a front plate 16 of the base unit 10, and a ribbon drive stepper motor 18 similarly mounted upon the front plate 16. Coupled to the motor shaft 14S of the print head stepper motor 14 is a pivotable print head carrier 20 which supports a print head 22.

Coupling of the print head carrier 20 to the motor shaft 14S is by means of a parallelogram linkage disposed behind the front plate 16 and comprising a first crank 24 fixed to the motor shaft 14S, a connecting link or rod 26, and a second crank 28 generally in the form of a semi-circular plate which is mounted upon a shaft 30 supporting the print head carrier 20. Shaft 30 comprises a boss 30B on the front side of the plate 16, with an axially extending tongue 30T to which the print head carrier 20 is bolted.

The motor shaft 18S of the ribbon drive stepper motor 18 is attached to a drive spindle 32 which, like the print head carrier 20, projects perpendicularly from the front plate 16 of the base unit 10.

For clarity, the ribbon cassette unit 12 is shown in FIG. 1 spaced from the base unit 10. In practice, when mounted upon the base unit 10, the cassette unit 12 is closer to the base unit 10 such that ribbon spools 34,36, which are rotatably mounted upon a front plate 38 of the cassette unit 12, are co-extensive with the print head 22 in terms of their location in a direction perpendicular to the front plate 38 of the base unit 10. Also attached to the cassette unit front plate 38 is a ribbon drive roller 40 which is visible in FIG. 1 below ribbon spool 34, and is also visible in FIG. 3.

The relative positioning of the ribbon spools 34,36, the print head 22, and the ribbon drive roller 40 may be ascertained by comparison of FIG. 1 with FIG. 3. The ribbon 42 is itself shown in full lines in FIG. 3, but in phantom lines in FIG. 1 for clarity. Certain items shown in FIG. 1 are not shown in FIG. 2, and vice versa. In particular, a platen roller 44 and a deflection roller 46 are shown in FIG. 2 but not in FIGS. 1 and 3. These components are mounted upon the printer frame or other apparatus with which the printer is associated.

Referring now to FIG. 2, continuous film material to be printed, and shown by reference character 50, enters the printer at an inlet region 52, passes over and wraps around platen roller 44 from which it follows a downwardly inclined path so as to pass underneath and wrap around the deflection roller 46 before passing to an outlet region 54 of the printer. The positioning of platen and deflection rollers 44 and 46 is such that the film substrate 50 is never deflected through an angle greater than 60° by any one guiding element, and preferably not greater than 45°. The function of the deflection roller 46 may be performed instead by any deflecting support for the film substrate 50 positioned so as to cause the substrate 50 to be wrapped partly around the platen roller 44. Both platen roller 44 and deflection roller 46 have axes of rotation which extend at right angles with respect to the direction of travel of the substrate film 50, and both axes are fixed in position so that the path of the substrate film 50 remains substantially constant during and between successive printing operations. As a result, the instantaneous rate at which the film 50 passes over the platen roller 44 always matches the rate at which it is supplied to and extracted from the printer through the inlet and outlet regions 52 and 54.

The thermal transfer print ribbon 42 follows a ribbon path which is as follows. Firstly, a supply of the print ribbon 42 is provided upon the feed spool 36 which is mounted by means of a bearing, not shown, which is fixed to the cassette unit front plate 38. A predetermined amount of friction is built into this bearing so as to maintain tension within the print ribbon 42. From spool 36, the print ribbon 42 passes over a break detector roller 58 which is attached to the end of a break detector arm 60 which is rotatable around the rotation axis of the feed spool 36 and biased in the clockwise direction as seen in FIG. 3 by means of a spring 62. From roller 58, the ribbon 42 passes over guide rollers 64 and 66 which are attached to the cassette unit front plate 38 and thence through a region which, when the cassette unit 12 is loaded into the base unit 10, is interposed between the print head 22 and the platen roller 44. The ribbon 42 then passes over another guide roller 68. The print head 22 and the platen roller 44 are seen in FIG. 2, as are also guide rollers 66 and 68, so that the location of the ribbon path relative to the print head 22 and the platen roller 44 can be seen. When the ribbon 42 passes over the platen roller 44, it is in frictional contact with the substrate film 50. The ribbon 42 is held in contact with the substrate film 50 only between the start and finish of each printing operation, during which the lower surface of the print head 22 bears against the platen roller 44 and through means of the ribbon 42 and film 50, as shown in FIG. 2. At other times, the print head 22 is raised away from the platen roller 44 by means of the operation of stepper motor 14.

From the print head 22, the print ribbon 42 travels over guide roller 70 and is then wrapped around the drive roller 40. A pinch roller 72, mounted upon a pivotable support arm 74, maintains the print ribbon 42 in gripping contact with drive roller 40. Drive roller 40 has a rubber sleeve and is driven by stepper motor 18 through means of a toothed belt 75 and toothed pulleys 75P disposed behind base unit front plate 16 upon the motor shaft 18S and the spindle 32, shown in FIGS. 1 and 2, so that the ribbon 42 is pulled through the space defined between the print head 22 and the platen roller 44. From the drive roller 40, the ribbon 42 passes to take-up spool 34 which is belt-driven by means of a belt 76 from a pulley 78, as shown in FIG. 1, which is mounted upon the shaft of drive roller 40. The mounting bearing, not shown, of the take-up spool 34 is mounted upon a shaft fixed to the cassette unit front plate 38 and, similar to the mounting bearing of the feed spool 36, has a predetermined amount of friction built in. The diameter of the pulley 34P associated with take-up spool 34, together with the diameter of the pulley 78 associated with drive roller 40, are such that the shaft mounting the take-up spool 34 is always driven faster than the speed of rotation necessary to take up the ribbon 42 from the drive roller 40, regardless of the diameter of the ribbon reel. The friction slip built into the connection between spool 34 and the belt-driven shaft allows the respective speeds of rotation of the drive roller 40 and the take-up spool 34 to be different from each other.

The print head 22 has side-facing printing elements 82, as shown in FIG. 2, extending along a line parallel to the axis of rotation 84 of the print head carrier 20. These printing elements 82 project from a lower surface 86 of the print head 22 which, in the printing position of the print head 22, is tangential to the platen roller 44, as shown by the chain lines in FIG. 2. The arcuate locus followed by the line of printing elements 82 when the print head 22 is pivoted about axis 84 passes through the intersection of a tangent parallel to the print head lower surface 86 and the platen roller surface. Consequently, the print ribbon 42 and the substrate film 50 are pinched between the print head 22 and the platen roller 44 precisely at the line of printing elements 82. When these elements 82 are heated under electronic control, and the film 50 and the print ribbon 42 are passed together over the elements 82, ink is transferred from the print ribbon 42 to the film 50 so as to print characters and symbols according to pre-programmed information incorporated within the signals fed to the print head 22.

During printing, the print ribbon 42 is disposed in contact with the film 50 and normally travels at the same speed. This is achieved by mounting an optical shaft encoder on a shaft bearing the platen roller 44. The output of the encoder is representative of the speed of the film 50, and by processing the output signal, the stepper motor 18 for driving the ribbon drive roller 40 is adjusted such that the print ribbon 42 is driven at the correct speed. This synchronization between the print ribbon 42 and the film 50 can be maintained over a wide range of speeds.

Figure 4:
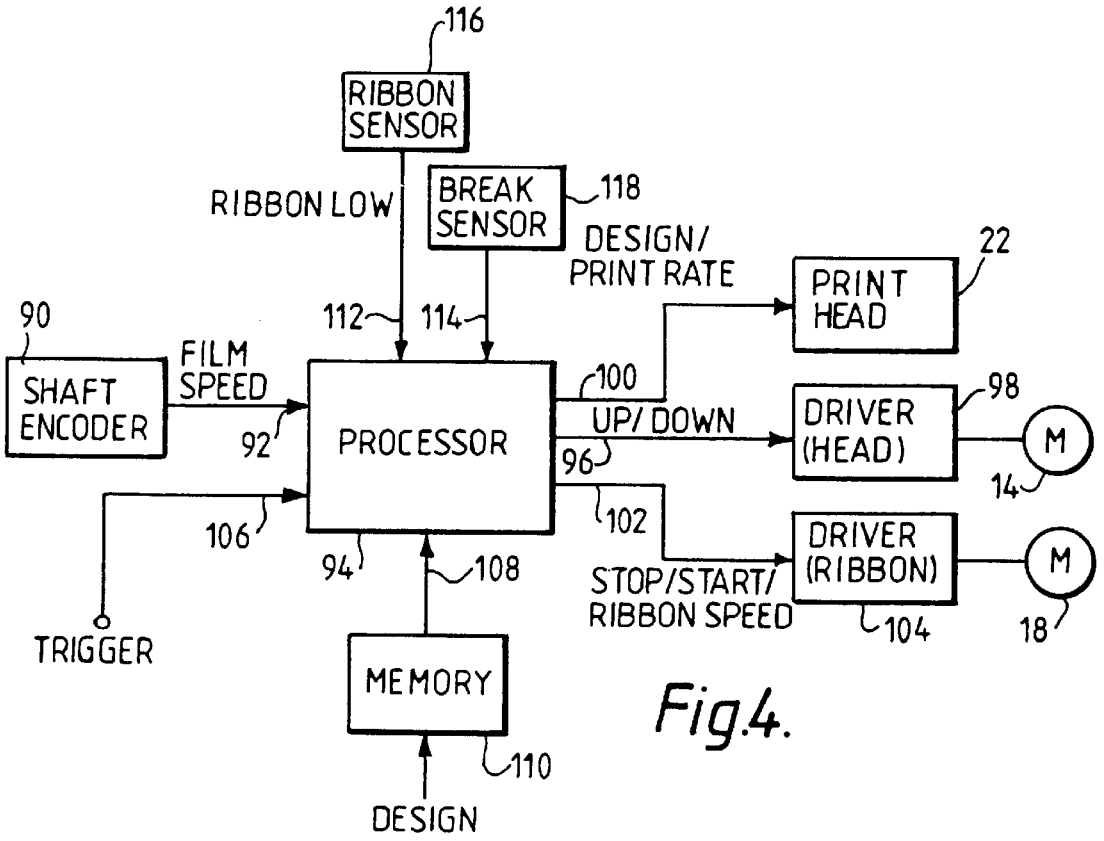
FIG. 4 is a block diagram showing the various electrical parts of the printer.

The print head 22 has a characteristic maximum printing rate or speed. Thus, if the print ribbon 42 and film 50 are always driven at the same speed, there will come a point at which the print head 22 reaches its maximum speed and where gaps are left in the usage of the print ribbon 42 because portions of the print ribbon 42 move past the print head 22 when the print head 22 is inoperative. As the print ribbon and film speed increases beyond the speed equivalent to the maximum printing speed of the print head 22, the gaps in the ribbon usage become larger. The processor 94, as shown in FIG. 4, is therefore arranged to drive the stepper motor 18 such that the print ribbon 42 moves at the same speed as the film 50 until the print head 22 is operating at its maximum rate and the used portions of the print ribbon 42 are spaced as compactly as possible. At this point, no further increase in the speed of the print ribbon 42 is permitted. Thus, any further increase in the speed of the film 50 results in "slip-page" between the print ribbon 42 and the film 50. In this way, maximum use is made of the print ribbon 42 and yet the speed of the film 50 is not limited by the speed of the print head 22.

The preferred embodiment of the present invention thermal printer is capable of operating at a film speed of 400 mm per second.

The shaft encoder associated with the platen roller 44 is shown in FIG. 4 by reference numeral 90. Shaft encoder 90 provides an input signal representative of the film speed to an input 92 of the processor unit 94. The processor unit 94 has at its heart a microprocessor, and has three outputs. The outputs comprise a first output 96 coupled to a first motor drive circuit 98 for moving the print head 22 between its inactive retracted position and its active extended position, respectively shown in FIG. 2, by means of stepper motor 14 and its associated linkage.

A second output of the processor unit 94 is a multi-wire input 100 coupled to the energizable elements 82 of the print head 22.

The third output 102 is coupled to a second motor driver 104 so as to control stepper motor 18, thereby stopping and starting the print ribbon 42, and for controlling the ribbon speed during each printing operation.

Other inputs to the processor unit 94 include trigger input 106 which receives a trigger signal initiating each printing operation. Typically, the trigger signal is generated by sensing the position of products, to which the substrate film 50 is to be applied as packaging, as the products travel along an adjacent conveyor. Another input 108 to processor unit 94 receives the information to be printed from a memory 110. Thus, on receipt of a trigger signal at input 106, the processor unit 94 is programmed to firstly move the print head 22 to its extended position, to start the ribbon drive motor 18, and to initiate printing by energizing the print elements 82 of the print head 22 in accordance with the information stored in the memory 110 so as to thereby print the information as a pattern or a series of characters.

While the printing operation is progressing, the speed at which the print ribbon 42 is driven by means of the driver 104 and stepper motor 18 is determined according to the film speed signal input received by the processor unit 94 at input 92, so as to drive the print ribbon 42 at the same speed as the film 50 up to the maximum speed as described above. The rate at which the print head elements 82 are driven, that is, the rate at which the pattern or characters are printed, is also varied by the processor unit 94 according to the film speed signal input 92.

It will be appreciated that when the speed of the film 50 passes the print head 22 at a speed which is greater than that equivalent to the maximum printing speed of the print head 22, although the ribbon speed is limited to save ribbon 42, the dots formed upon the film 50 will still be spaced apart in the travel direction of the film 50. Thus, the characters or patterns formed on the film 50 will appear to be stretched in the travel direction of the film 50. To overcome this, in accordance with the preferred embodiment of the invention, the characters or patterns are compressed by periodically selectively omitting or skipping a line of dots.

Figures 6, 7:
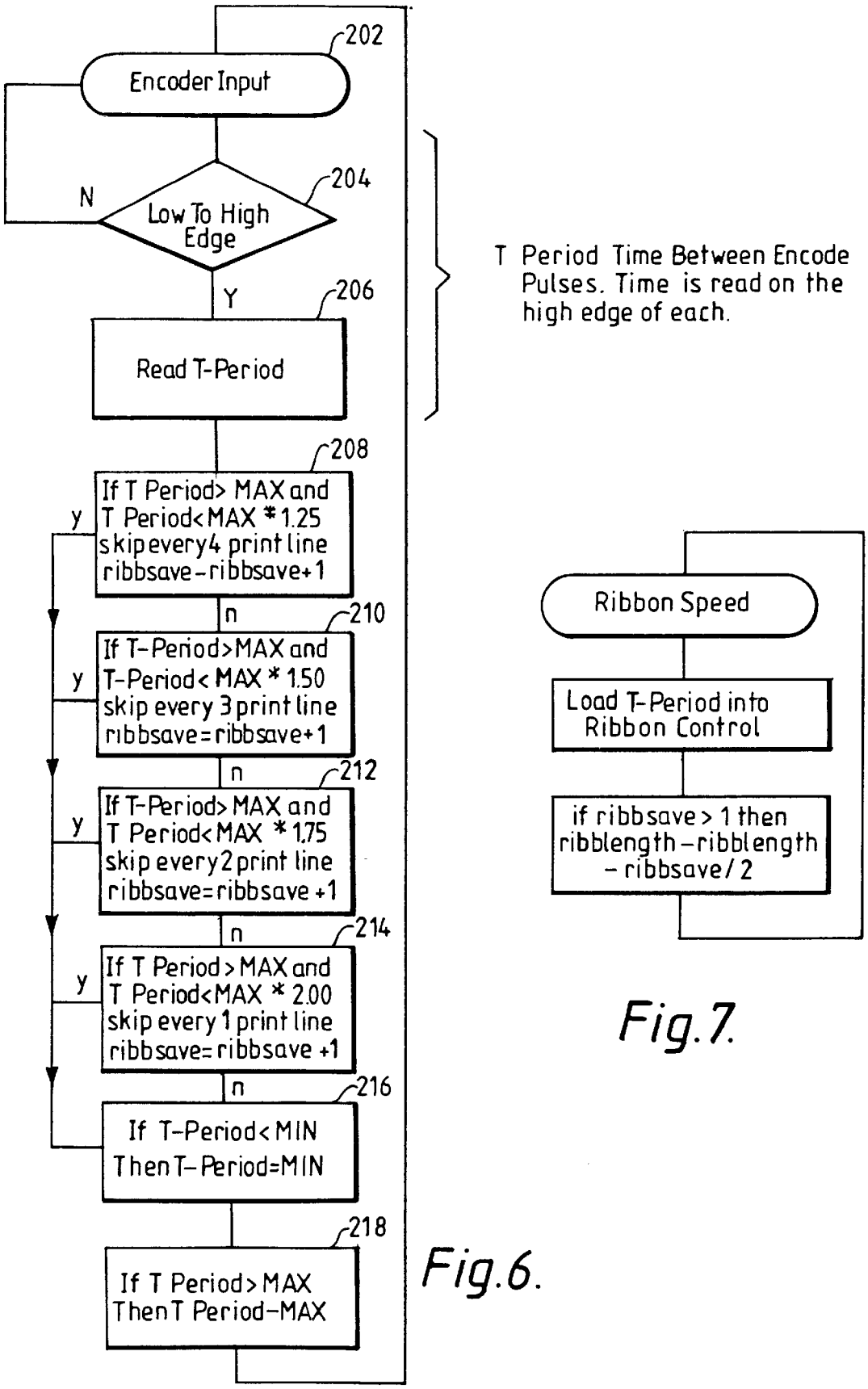
FIG. 6 is a flow chart of part of the software of the printer of FIG. 1.
FIG. 7 is a flow chart of another part of the soft-ware of the printer of FIG. 1.

With reference now being made to FIGS. 6 and 7, two of the software processes capable of being executed in the processor 94 are shown. Steps 202,204,206 operate in a loop so as to derive a measurement of the speed of the film 50 by reading the "T-Period" which is the time period between encoder pulses generated by the shaft encoder 90. In accordance with the preferred embodiment, the T-Period is measured between the rising edges of the series of encoder pulses.

In steps 208,210,212,214, the measured T-period is compared with MAX which is a stored value which represents the maximum film speed at which characters are printed at the correct aspect ratio on the film 50 while the print head 22 is operating at its maximum printing rate. Each of these steps also increments a "ribsave" variable which is used by the ribbon control loop as described below in connection with FIG. 7.

Considering step 208, for example, if the T-Period is between MAX and MAX×1.25, then after every four lines are printed, the next line is skipped. Thus, a fifth of the lines are skipped on average which has the effect of compressing the character or pattern being printed by ⅕ such that the resulting pattern has a pattern extent of ⅘. Since the film 50 is measured as passing the head at a speed of 1.25, that is, ⅝ of the maximum printing speed, the effect of compressing the characters or pattern by ⅕ such that the resulting pattern has a pattern extent of ⅘ is to restore the aspect ratio of the printed characters or pattern by bringing the character width back to 1, that is, the normal width. Similarly, steps 210, 212,214 restore the aspect ratio of the printed characters or pattern for film speeds greater than MAX up to the point in step 214 wherein the film speed is twice the speed of the maximum printing speed of the print head 22 whereby it is required that every other line be skipped so as to compress the characters or pattern by one-half in the travel direction of the film 50.

Steps 216 and 216 limit the "T-Period" to be between MIN and MAX, namely, the preferred minimum ribbon speed and the maximum speed respectively, the maximum speed being the speed which is equivalent to the maximum printing rate of the print head 22 as described above. The "T-Period" is used in the ribbon control loop described below.

FIG. 7 shows the process which controls the ribbon speed by loading the "T-Period" into the ribbon control segment of the software which ultimately controls the stepper motor 18. This process matches the ribbon speed to the film speed as discussed above until the film speed reaches the speed which is equivalent to the maximum printing speed of the print head 22 at which point the ribbon speed is maintained constant until the film speed decreases below the speed equivalent to the maximum speed of the print head 22. The variable "ribsave" is used to adjust a variable "riblength" which maintains a record of the amount of print ribbon 42 remaining.

When the processor 94 senses that all of the information relating to the required design has been supplied from the memory 110 and has been fed to the print head 22, it issues a stop signal to the ribbon driver 104 so as to stop ribbon travel, and the driver 98 for the print head stepper motor 14 receives a signal causing the motor 14 to withdraw the print head 22 to its retracted, inactive position. The processor 94 then waits for the next trigger signal at input 106 before repeating the above process. Further inputs 112,114 of the processor 94 are received respectively from a ribbon status sensor 116 and a ribbon break sensor 118 which are respectively associated with a spring-loaded pivotable arm 120 as seen in FIG. 3. This arm 120 has a roller 122 at its distal end contacting the periphery of the ribbon supply disposed upon the ribbon supply spool 36 so that when the ribbon supply runs low, an alarm can be activated and/or operation of the packaging apparatus, of which the printer is a part, can be halted. Similarly, the break sensor 118 is responsive to excessive clockwise movement of arm 60, as shown in FIG. 3, so as to sense any breakage of the print ribbon 42 which, during normal operation, keeps roller 58 approximately at the position shown in FIG. 3.

Further details of the preferred printer in accordance with the invention will now be described. Limits on the movement of the print head carrier 20 and print head 22 are determined firstly by the striking of the print head elements 82 against the platen roller 44, as seen in FIG. 2, through means of the print ribbon 42 and the film 50, and in the retractive position, by an adjustable stop, not shown, associated with the semi-circular plate 28 behind the front plate 16 of the base unit 10.

Figure 5:
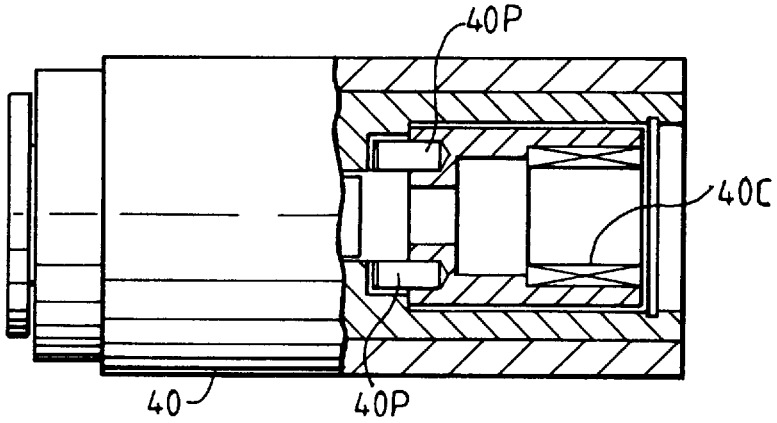
FIG. 5 is a plan view of a ribbon drive roller for the printer of FIG. 1.

Drive to the ribbon drive roller 40, which, as has been shown, is mounted upon the cassette front plate 38, is transferred from the base unit 10 to the roller 40 by means of drive spindle 32 as shown in FIG. 1. Referring to FIG. 5, roller 40 contains a clutch bearing 40C which is mounted within the roller 40 in such a manner that it is allowed to float in the sense that the center of clutch bearing 40C need not coincide exactly with the center of the roller 40. When the cassette unit 12 is mounted upon the base unit 10, the drive shaft or spindle 32 attached to ribbon drive motor 18, as seen in FIG. 1, enters clutch bearing 40C as seen in FIG. 3. Needle rollers of the clutch bearing 40C, which are self-locking when driven in one rotary direction, engage the outer surface of shaft or spindle 32 and drive is transferred from spindle 32 to the clutch bearing 40C and then by means of pins 40P to the roller 40. The floating nature of the clutch bearing 40C within the roller 40 allows for a degree of mismatch between the axis 128 of drive spindle 32 and the axis 130 of roller 40 when the cassette unit 12 is mounted upon the base unit 10.

The cassette unit 12 is located upon the base unit 10 by means of a retention pin 132 and a tubular socket 134 as shown in FIG. 1.

Obviously, many modifications and variations of the present invention are possible in light of the above teachings. It is therefore to be understood that within the scope of the appended claims, the present invention may be practiced otherwise than as specifically described herein.

I claim:

1. A thermal printer for printing on a continuous print medium by means of ink transfer from a thermal print ribbon, comprising:

means defining a print medium path along which a print medium is conducted;

a thermal print head having energizable print elements and located adjacent to said print medium path;

means defining a print ribbon path which extends substantially in the same direction as said print medium path and along which a print ribbon is conducted such that said print ribbon is interposed between said print head and said print medium;

ribbon drive means operable to drive said print ribbon at varying speeds along said print ribbon path;

speed sensing means operable to sense the speed of travel of said print medium along said print medium path; and processing means, including memory means, for controlling said ribbon drive means in order to vary the speed, at which said print ribbon is driven, up to a maximum speed substantially corresponding to the maximum printing speed of said print head, for energizing selected ones of said print elements according to predetermined patterns of dots stored within said memory means so as to cause the transfer of ink from said print ribbon to said print medium in accordance with a predetermined one of said patterns of ink dots as said print medium moves past said print head along said print medium path, and for monitoring the speed of said print medium using said speed sensing means such that when the speed of said print medium is greater than said maximum ribbon and print head speeds, said print elements are energized such that selected ink dots are omitted from said predetermined pattern of ink dots formed upon said print medium.

2. A printer according to claim 1, wherein:

said processing means comprises means for causing said dots to be omitted by periodically skipping a set of dots and instead energizing said print elements according to the subsequent set of dots stored within said memory means.

3. A printer according to claim 2, wherein:

said processing means comprises means for skipping X sets of said dots, wherein X=1—(MAX)/speed of print medium, in which MAX is the print medium speed substantially corresponding to said maximum printing speed of said print head.

4. A printer according to claim 3, wherein:

said processing means comprises means for reducing, for each two sets of dots skipped, the amount of ribbon fed past said print head by an amount substantially equal to the length of ribbon used for printing one set of dots.

5. A printer as set forth in claim 1, wherein:

said processing means comprises control means operatively connected to said speed sensing means for receiving a speed sensor output signal therefrom and operatively coupled to said ribbon drive means for driving said ribbon drive means at a rate of speed dependent upon said speed sensor output signal.

6. A printer as set forth in claim 5, wherein:

said ribbon drive means comprises a ribbon drive roller operatively connected to a ribbon drive motor; and said control means is operatively connected to said ribbon drive motor so as to cause said ribbon drive motor to be driven at a rate of speed which is dependent upon said sensor output signal.

7. A printer as set forth in claim 6, further comprising:

drive spindle means for operative coupling to said ribbon drive roller;

first pulley means operatively connected to said ribbon drive motor;

second pulley means operatively connected to said drive spindle means; and first pulley belt means operatively interconnecting said first pulley means to said second pulley means so as to transmit drive from said ribbon drive motor to said drive spindle means and said ribbon drive roller.

8. A printer as set forth in claim 7, further comprising:

one-way clutch means disposed within said ribbon drive roller and operatively connectable to said drive spindle means for transmitting drive from said drive spindle means to said ribbon drive roller.

9. A printer as set forth in claim 7, further comprising:

a ribbon supply spool for supplying said print ribbon in preparation for a printing operation; and a ribbon take-up spool for receiving print ribbon which has been used in a printing operation.

10. A printer as set forth in claim 9, wherein:

said printer comprises a base unit and a ribbon cassette;

said ribbon drive motor, said first and second pulleys, and said spindle drive means are mounted upon said base unit; and said ribbon drive roller, said ribbon supply spool, and said ribbon take-up spool are mounted upon said ribbon cassette.

11. A printer as set forth in claim 9, further comprising:

third pulley means mounted upon said ribbon drive roller;

fourth pulley means mounted upon said ribbon take-up spool;

second pulley belt means operatively interconnecting said third and fourth pulley means for transmitting drive from said ribbon drive roller to said ribbon take-up spool.

12. A printer as set forth in claim 1, wherein:

said processing means comprises control means operatively connected to said speed sensing means for receiving a speed sensor output signal therefrom and operatively connected to said print head for energizing said print elements in accordance with said speed sensor output signal.

13. A printer as set forth in claim 1, wherein:

said speed sensing means comprises an optical shaft encoder.

14. A printer as set forth in claim 1, wherein:

said processing means comprises control means operatively connected to said speed sensing means for receiving a speed sensor output signal therefrom and operatively connected to said thermal print head for moving said thermal print head toward and away from said print ribbon path in response to said speed sensor output signal.

15. A printer as set forth in claim 14, wherein:

said thermal print head is mounted upon a pivotable thermal print head carrier which is operatively connected to a print head drive motor; and said control means is operatively connected to said print head drive motor so as to drive said print head drive motor which thereby oscillates said pivotable thermal print head carrier.

16. A method of saving ribbon in a thermal printer which prints upon a continuous print medium by ink transfer from a thermal print ribbon and wherein the thermal printer includes a thermal print head having energizable print elements, the method comprising the steps of:

driving a print medium past said thermal print head at a speed which can be greater than a maximum printing speed characteristic of said thermal print head;

driving a thermal print ribbon past said thermal print head in the same direction as said print medium at a speed substantially equal to said maximum printing speed of said thermal print head;

providing a memory having stored therein predetermined patterns of dots;

selectively energizing predetermined ones of said print elements of said thermal print head according to predetermined patterns of dots stored within said memory so as to transfer ink from said thermal print ribbon to said print medium in accordance with a predetermined one of said predetermined patterns of ink dots as said print medium is driven past said print head; and periodically omitting selected ink dots from said predetermined one of said predetermined patterns of ink dots formed upon said print medium when the speed of said print medium is greater than said maximum ribbon and print head speeds.

17. The method as set forth in claim 16, further comprising the step of:

omitting said selected ink dots from said predetermined pattern of ink dots by periodically skipping a set of ink dots and replacing said skipped set of ink dots with a subsequent set of ink dots.

18. A method according to claim 17, further comprising the step of:

skipping X sets of said ink dots, wherein X=1—(MAX) /speed of print medium, in which MAX is the print medium speed substantially corresponding to said maximum printing speed of said print head.

19. The method as set forth in claim 18, further comprising the step of:

reducing, for each two sets of dots skipped, the amount of ribbon fed past said thermal print head by an amount substantially equal to the length of ribbon used for printing one set of dots.

20. The method as set forth in claim 16, further comprising the steps of:

sensing the rate of speed of said print medium; and driving said print ribbon at a rate of speed which is variable in response to said sensed rate of speed of said print medium.

21. A thermal printer for printing on a continuous print medium by means of ink transfer from a thermal print ribbon, comprising:

means defining a print medium path along which a print medium is conducted;

a thermal print head having energizable print elements and located adjacent to said print medium path;

means defining a print ribbon path which extends substantially in the same direction as said print medium path and along which a print ribbon is conducted such that said print ribbon is interposed between said print head and said print medium;

ribbon drive means operable to drive said print ribbon at varying speeds along said print ribbon path;

speed sensing means operable to sense the speed of travel of said print medium along said print medium path; and processing means, including memory means, for controlling said ribbon drive means in order to vary the speed, at which said print ribbon is driven, up to a maximum speed substantially corresponding to the maximum printing speed of said print head, for energizing selected ones of said print elements according to predetermined line patterns of dots stored within said memory means so as to cause the transfer of ink from said print ribbon to said print medium in accordance with a predetermined one of said line patterns of ink dots as said print medium moves past said print head along said print medium path, and for monitoring the speed of said print medium using said speed sensing means such that when the speed of said print medium is greater than said maximum ribbon and print head speeds, said print elements are energized such that a selected line of ink dots is omitted from said predetermined line pattern of ink dots formed upon said print medium.

22. A printer as set forth in claim 21, wherein said processing means comprises:

means for omitting X lines of said dots wherein $$X = 1 - \frac{\text{maximum speed of ribbon/print head}}{\text{speed of print medium.}}$$

23. A method of saving ribbon in a thermal printer which prints upon a continuous print medium by ink transfer from a thermal print ribbon and wherein the thermal printer includes a thermal print head having energizable print elements, the method comprising the steps of:

driving a print medium past said thermal print head at a speed which can be greater than a maximum printing speed characteristic of said thermal print head;

driving a thermal print ribbon past said thermal print head in the same direction as said print medium at a speed substantially equal to said maximum printing speed of said thermal print head;

providing a memory having stored therein predetermined line patterns of ink dots;

selectively energizing predetermined ones of said print elements of said thermal print head according to predetermined line patterns of dots stored within said memory so as to transfer ink from said thermal print ribbon to said print medium in accordance with a predetermined one of said predetermined line patterns of ink dots as said print medium is driven past said print head; and periodically omitting a selected line of ink dots from said predetermined one of said predetermined line patterns of ink dots formed upon said print medium when the speed of said print medium is greater than said maximum ribbon and print head speeds.

24. The method as set forth in claim 23, further comprising the step of:

omitting X lines of said dots wherein $$X = 1 - \frac{\text{maximum speed of ribbon/print head}}{\text{speed of print medium.}}$$

* * * * *